US005242552A

United States Patent [19]

Coin et al.

[11] Patent Number: 5,242,552

[45] Date of Patent: Sep. 7, 1993

[54] SYSTEM FOR ELECTROLYTICALLY GENERATING STRONG SOLUTIONS BY HALOGEN OXYACIDS

[75] Inventors: Richard J. Coin, Mentor; Joseph E. Elliott, Painesville Township, Lake County; Eric J. Rudd, Painesville; Anthony R. Sacco, Mentor, all of Ohio

[73] Assignee: Eltech Systems Corporation, Boca Raton, Fla.

[21] Appl. No.: 735,094

[22] Filed: Jul. 25, 1991

Related U.S. Application Data

[63] Continuation-in-part of Ser. No. 497,038, Mar. 21, 1990, abandoned.

[51] Int. Cl.[5] ..... C25B 1/24

[52] U.S. Cl. ..... 204/95

[58] Field of Search ..... 204/82, 95-96, 204/98, 101, 103, 129, 182.3, 182.4; 423/472, 475-478

[56] References Cited

U.S. PATENT DOCUMENTS

| | | | |
|---|---|---|---|
| 2,829,095 | 4/1958 | Oda et al. | 204/98 |
| 2,840,519 | 6/1958 | Stern et al. | 204/82 |
| 3,222,267 | 12/1965 | Tirrell et al. | 204/98 |
| 3,523,755 | 8/1970 | McRae | 423/539 |
| 3,810,969 | 5/1974 | Schlumberger | 423/478 |
| 3,904,496 | 9/1975 | Harke et al. | 204/98 |
| 4,115,217 | 9/1978 | Larsson et al. | 204/95 |
| 4,504,373 | 3/1985 | Mani et al. | 204/301 |
| 4,740,281 | 4/1988 | Chlanda et al. | 204/182.4 |
| 4,798,715 | 1/1989 | Hardee et al. | 423/478 |
| 4,915,927 | 4/1990 | Lipsztajn et al. | 423/472 |

OTHER PUBLICATIONS

Ullmann's *Encyclopedia of Industrial Chemistry*, 1986, pp. 496-501.

*Primary Examiner*—John Niebling
*Assistant Examiner*—C. Delacroix-Muirheid
*Attorney, Agent, or Firm*—John J. Freer

[57] ABSTRACT

The present invention resides in a process and apparatus for the electrolytic production of strong solutions of halogen oxyacids, more specifically for the production of such acids having a normality of about 0.1 to about 3.6 from the corresponding alkali metal salts of such acids. The present invention comprises establishing a solution of the corresponding alkali metal salt having a molar concentration less than that at which precipitation of said salt occurs. An electrolytic cell is provided comprising an anode compartment containing an anode, a cathode compartment containing a cathode, and a middle feed compartment intermediate the anode compartment and cathode compartment. The feed compartment is separated from the anode compartment by a diaphragm and from the cathode compartment by a cation-selective membrane. Means are provided for introducing said alkali metal salt solution into said middle feed compartment and for applying a voltage between the anode and cathode. Under the influence of the applied voltage, the alkali metal ions migrate through the cation-selective membrane to the cathode, reacting with hydroxyl ions to form alkali metal hydroxide, and the oxyhalogen ions migrate through the diaphragm to the anode reacting with protons to form halogen oxyacid. Means are provided for maintaining the cell at a temperature in the range of about 10° C. to about 40° C.

2 Claims, 1 Drawing Sheet

SYSTEM FOR ELECTROLYTICALLY GENERATING STRONG SOLUTIONS BY HALOGEN OXYACIDS

This is a continuation-in-part of copending application Ser. No. 07/497,038 filed on Mar. 21, 1990, now abandoned.

BACKGROUND OF THE INVENTION

1. Technical Field

The present invention relates to a process and apparatus for electrolytically generating strong solutions of halogen oxyacids from the corresponding alkali metal salt. The present invention will be particularly described with reference to generating a chloric acid ($HClO_3$) solution of high normality from sodium chlorate ($NaClO_3$). However, it will be apparent to those skilled in the art that the present invention is also applicable to the generation of other oxyacids, for instance perchloric acid ($HClO_4$) from sodium perchlorate ($NaClO_4$).

2. Description of the Prior Art

One problem with halogen oxyacids such as chloric acid is that they are unstable and subject to decomposition, particularly at elevated temperatures. This prevents them from being easily stored and shipped requiring that they be made at a point of use rather than on a large industrial scale. Present commercial methods for generating chloric acid on site acidify sodium chlorate with sulfuric acid. This produces an impure product stream containing sodium sulfate which has to be removed, and which is of little value as a by-product.

U.S. Pat. No. 4,798,715, assigned to the assignee of the present application discloses the production of chloric acid from sodium chlorate using an ion exchange resin. Chlorine dioxide is then manufactured by reducing the chloric acid in an electrochemical cell. It is disclosed in the patent that the chloric acid feed to the electrochemical cell can have a normality of about 0.5 up to about 4.5. However, it is desirable to feed chloric acid to the electrochemical cell at a relatively high normality, for instance, above about 1.5, in order to obtain reduction of the chloric acid to chlorine dioxide at optimum efficiency.

U.S. Pat. No. 3,810,969 also discloses the manufacture of chloric acid by reacting an alkali metal chlorate with a stoichiometric excess of a cation exchange resin. One problem with the use of a cation exchange resin is that such resins have a relatively short lifetime, increasing the cost of manufacture of chloric acid.

It is known to produce acids using an electrolytic cell. U.S. Pat. No. 4,115,217 discloses the use of a three-compartment electrolytic cell for the preparation of sodium chlorite ($NaClO_2$) from sodium chlorate ($NaClO_3$), sulfuric acid, and sulfur dioxide. A product of the process of this patent is enriched sulfuric acid ($H_2SO_4$) instead of chloric acid. The process comprises reacting the sodium chlorate in a reactor with the sulfur dioxide to produce a residual solution of sodium sulfate and sulfuric acid. Chlorine dioxide ($ClO_2$) is also formed in the reactor and is removed in an inert gas stream. The residual solution containing sodium sulfate and sulfuric acid is fed into the middle compartment of the electrolytic cell. The middle compartment is defined on one side by an anion selective membrane and on the opposite side by a cation selective membrane. The end compartments of the cell are an anode compartment separated from the middle compartment by the anion selective membrane and a cathode compartment separated from the middle compartment by the cation selective membrane. When a voltage is applied to the cell, sulfate ions migrate from the middle compartment through the anion selective membrane into the anode compartment. At the anode, water is decomposed with the evolution of oxygen and generation of hydrogen ions which react with the migrated sulfate ions to form sulfuric acid. The chlorine dioxide formed in the reactor is fed into the catholyte of the three-compartment cell and is reduced to chlorite ions ($ClO_2^-$) at the cathode. The cations in the middle compartment, mainly sodium and hydrogen ions, migrate through the cation selective membrane. The sodium ions react with the chlorite ions formed at the cathode to form sodium chlorite which is precipitated in the cathode compartment when saturation is reached.

Problems arise, however, when an electrolytic cell such as that disclosed in U.S. Pat. No. 4,115,217 is attempted to be used in the manufacture of a strong halogen oxyacid such as chloric acid. For one, such cells are known to generate substantial amounts of heat because of solution and separator resistance, which can lead to acid decomposition. In addition, the halogen oxyacids at high temperature are highly corrosive preventing many materials conventionally employed in electrolytic cells from being used in association with the oxyacids.

U.S. Pat. No. 3,222,267 also describes a three-compartment cell. An electrolytic solution is electrolyzed in such a manner as to produce salt-free product hydroxide and the corresponding acid salt of sodium bisulfate. By way of example, a 10% sodium sulfate solution was introduced into a center feed compartment. The flow rate and pressure of the solution is sufficient for the solution to percolate through a porous diaphragm into an anode compartment. The flow rate and pressure also prevents back migration or diffusion of protons toward the cell cathode. Water is introduced into the cathode compartment. Electrolysis in the cell produces a 2N sodium hydroxide catholyte effluent and a 0.075N acid anode effluent. As in U.S. Pat. No. 4,115,217, the compositions of the solutions, were not such that decomposition of the effluents, or corrosion of materials conventionally used in such a cell, were a problem.

A disclosure similar to that of U.S. Pat. No. 3,222,267 is contained in U.S. Pat. No. 3,523,755.

U.S. Pat. No. 2,829,095 discloses a process for the production of acidic solutions in an electrolytic cell using a plurality of anion exchange and cation exchange membranes. There is no disclosure concerning the production of halogen oxyacids.

U.S. Pat. No. 4,504,373 discloses a three-compartment electrodialytic cell and feeding alkali metal sulfate values to the cell.

U.S. Pat. No. 4,740,281 discloses supplying a salt and acid to one compartment of an electrodialysis apparatus and a liquid containing water to a second compartment of the apparatus. The process is for regenerating acids from stainless steel pickling baths.

SUMMARY OF THE INVENTION

The present invention resides in a process and apparatus for the electrolytic production of strong solutions of halogen oxyacids. The present invention comprises establishing a solution of the corresponding alkali metal salt. An electrolytic cell is provided comprising an anode compartment containing an anode, a cathode compartment containing a cathode, and a middle feed compartment intermediate the anode compartment and cathode compartment. The middle feed compartment is separated from the anode compartment by a separator which is a porous diaphragm and from the cathode compartment by a cation selective membrane. Means are provided for introducing said alkali metal salt solution into said feed compartment and for applying a voltage between the anode and the cathode Under the influence of the applied voltage, the alkali metal ions formed by the disassociation of the salt migrate through the cation selective membrane to the cathode, reacting with electrochemically produced hydroxyl ions to form alkali metal hydroxide. The oxyhalogen ions formed by the disassociation of the salt migrate through the porous diaphragm between the middle compartment and the anode compartment, to the anode, reacting with electrochemically formed protons to form halogen oxyacid. Means are provided for cooling the electrolytic cell. It was found that reducing the temperatures in the electrolytic cell allowed the use of diaphragms and other materials of construction that would not otherwise be allowed, and also inhibits decomposition of the halogen oxyacid, that might otherwise occur. The electrolytic cell and acid product preferably are cooled to a temperature in the range of about 10° C. to about 40° C.

BRIEF DESCRIPTION OF THE DRAWING

Further features of the present invention will become apparent to those skilled in the art to which the present invention relates from reading the following specification with reference to the accompanying drawing in which the Figure is a flow diagram illustrating the process of the present invention.

DESCRIPTION OF THE PREFERRED EMBODIMENT

Figure 1:
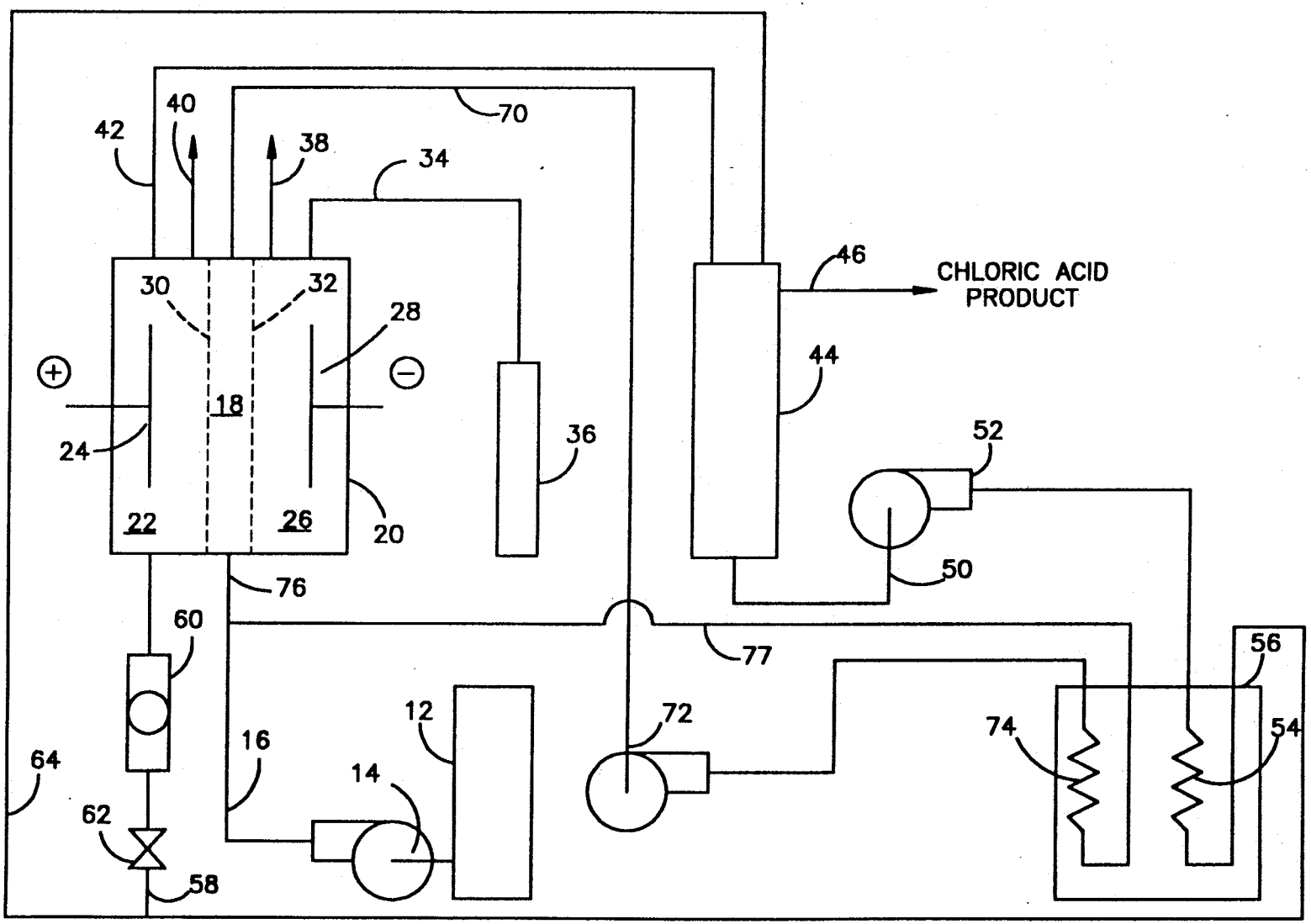

In the following description, the principals of the present invention will be disclosed by reference to a specific halogen oxyacid product and a specific alkali metal salt feed. The halogen oxyacid hereinafter disclosed is chloric acid and the alkali metal salt feed is sodium chlorate. It will be apparent to those skilled in the art that the principals of the present invention, as hereinafter disclosed, are applicable to the generation of other halogen oxyacids using as feed other alkali metal salts.

Referring to the Figure, a chloric acid generator is disclosed. A sodium chlorate solution is contained in feed tank 12. This solution can be obtained by dissolving sodium chlorate crystals in water, or by diluting a concentrated solution of sodium chlorate, by way of example. The sodium chlorate solution is pumped at a controlled feed rate, by a pump 14, through line 16 into the middle feed compartment 18 of a three-compartment electrolytic cell 20. One type of pump 14 that can be used is a positive displacement pump.

The electrolytic cell 20 comprises an anode compartment 22, containing an oxygen or chlorine evolving anode 24, and a cathode compartment 26 containing a cathode 28. The anode compartment 22 is separated from the middle compartment 18 by a separator 30. The separator 30 is a porous diaphragm. The cathode compartment 26 is separated from the middle compartment 18 by a cation-selective membrane 32, which is selective to the migration of cations.

In operation, the sodium chlorate in solution disassociates into positively charged sodium ions and negatively charged chlorate ions per the following equation:

$$NaClO_3 \rightleftharpoons Na^+ + ClO_3^- \quad (1)$$

Upon the influence of an impressed direct electric current in the cell 20, the cation constituents of the sodium chlorate solution, namely, positive sodium ions, pass through the cation-selective membrane 32 into the cathode compartment 26. Hydroxyl ions produced at the cathode 28 by the electrolysis of water react with the sodium ions to produce sodium hydroxide, per the following reactions:

$$2H_2O + 2e^- \rightarrow H_2 + 2OH^- \quad (2)$$

$$2OH^- + 2Na^+ \rightarrow 2NaOH \quad (3)$$

$$\text{Overall: } 2H_2O + 2e^- + 2Na^+ \rightarrow H_2 + 2NaOH \quad (4)$$

Under the influence of an impressed direct electric current in the cell 20, some water is carried into the cathode compartment 26 with the sodium ions. This dilutes the sodium hydroxide, the diluted sodium hydroxide being withdrawn from the cathode compartment 26 through a catholyte effluent line 34. In the embodiment illustrated in the Figure the catholyte effluent line 34 leads by way of example, to a sodium hydroxide storage tank 36. Hydrogen is also produced in the cathode compartment 26 by the electrolysis of water, and is vented from the compartment by means of a hydrogen vent 38.

The negatively charged chlorate ions in the middle feed compartment 18 migrate through the separator 30 into the anode compartment 22. In the anode compartment, the negatively charged chlorate ions combine with protons produced at the anode 24 by the electrolysis of water to produce chloric acid. The following reactions take place:

$$H_2O \rightarrow 2H^+ + \tfrac{1}{2}O_2 + 2e^- \quad (5)$$

$$ClO_3^- + H^+ \rightarrow HClO_3 \quad (6)$$

Oxygen evolved in the anode compartment 22 can be vented to atmosphere in oxygen vent line 40. Chloric acid ($HClO_3$) is withdrawn from the anode compartment 22 in anolyte effluent line 42 to acid storage tank 44. Acid product is withdrawn from the acid storage tank in acid product line 46.

The overall reaction for the production of chloric acid is:

$$3H_2O + 2NaClO_3 \rightarrow 2HClO_3 + H_2 + 2NaOH + \tfrac{1}{2}O_2 \quad (7)$$

Chloric acid is strong oxidizing acid and the separator 30, broadly, has to be resistant to this acid. Further, the separator 30 should have such properties that it causes a relatively low voltage drop in the acid generator, and allows anions to pass easily so that a high current density can be achieved. Broadly, the separator 30 is of a hydraulically porous nature, such as a diaphragm.

In the generator 20, protons are generated at the anode 24. There is a tendency, under the influence of an impressed direct electric current, for these protons to migrate to the cathode, which reduces the generator efficiency by direct reaction with $OH^-$ ions generated at the cathode. Preferably, the diaphragm has a pore size and pore density that creates a high fluid velocity such as to resist migration of the protons through the diaphragm, while at the same time sufficient to allow the transport of chlorate ions from the middle compartment 18 into the anode compartment 22.

A number of well known diaphragm materials which have resistance to oxidizing acids and have good electrical properties can be employed. A preferred porous diaphragm is one made of polyvinylidene fluoride (PVDF). Polyvinylidene fluoride has good resistance to chemical attack by chloric acid. The polyvinylidene fluoride diaphragms have recommended maximum service temperatures up to expected temperatures for the generator. The electrical and wetting properties of polyvinylidene fluoride are suitable for the process and apparatus of the present invention.

One suitable polyvinylidene fluoride (PVDF) diaphragm is marketed by Porex Technologies Corp. under the trademark POREX. The polyvinylidene fluoride (PVDF) is marketed by Pennwalt Corp. under the trademark KYNAR. The POREX diaphragms typically have an average pore size of about 25 microns, a void volume of about 40%, and a density of about 1.05 grams per cubic centimeter. Another suitable polyvinylidene fluoride (PVDF) diaphragm is one marketed by Millipore Corporation under the trademark DURAPORE.

Examples of other materials having resistance to chloric acid are polytetrafluoroethylene (PTFE), fiberglass, polyvinyl chloride (PVC), styrene-acrylonitrile, and ceramics. Most hydrocarbons, such as rubber, are readily attacked by strong oxidizing agents.

One porous polyvinyl chloride (PVC) diaphragm commercially available is marketed by Microporous Products Division of Amerace Corporation under the trademark AMERSIL. Porous polytetrafluoroethylene (PTFE) diaphragms are commercially available from Millipore Corporation under the trademark "FLUOROGARD", and from Norton Company under the trademark "ZITEX". The wettability of polytetrafluoroethylene (PTFE) or other fluorocarbons can be improved by treating the polytetrafluoroethylene or fluorocarbon with a surfactant such as ZONYL (trademark, E. I. DuPont de Nemours & Company). Alternatively, it is possible to compound into the polytetrafluoroethylene (PTFE), in the manufacture of the diaphragm, a wettable acid resistant filler such as ground NAFION (trademark, E. I. DuPont de Nemours & Company) or a ceramic such as borosilicate glass. NAFION is the trademark for a perfluorocarbon copolymer marketed by E. I. DuPont de Nemours & Co. It is also possible to improve the wettability of polytetrafluoroethylene or other fluorocarbon diaphragms by treating the diaphragms with a NAFION solution. The diaphragms can also be porous NAFION.

The cation selective membrane 32 is commonly of the type consisting of a cation exchange resin prepared in the form of thin sheets. A preferred membrane is a perfluorinated copolymer having pendant cation exchange functional groups. Broadly, these perfluorocarbons are a copolymer of at least two monomers with one monomer being selected from a group including vinyl fluoride, hexafluoropropylene, vinylidene fluoride, trifluoroethylene, chlorotrifluoroethylene, perfluoro (alkylvinyl ether), tetrafluoroethylene and mixtures thereof. The second monomer often is selected from a group of monomers usually containing an $SO_2F$ or sulfonyl fluoride pendant group. One suitable membrane is a perfluorocarbon membrane marketed by E. I. DuPont de Nemours & Company under the trademark NAFION.

Since chloric acid is a strong oxidizing agent, many materials used for separator 30 will be more susceptible to corrosion by the chloric acid at higher temperatures than at lower temperatures. Substantial electrical resistance and heat build-up, particularly in the separator 30 and across the middle compartment 18, at high current densities, can occur in the cell 20. An aspect of the present invention is cooling the cell 20 so as to maintain the separator 30 within a temperature range of about 10° C. to about 40° C., preferably at a temperature near to room temperature of about 20° C. (68° F).

The Figure discloses one method for cooling the cell 20. Referring to the Figure, a portion of the chloric acid in tank 44 is withdrawn in line 50 through circulation pump 52 to coil 54 of heat exchanger 56. The heat exchanger is maintained at a temperature effective to cool the acid in coil 54. The cooled acid is then recirculated to the anolyte compartment 22 by means of line 58. Line 58 contains a rotometer 60 which measures the amount of acid recirculated, and a flow control valve 62 to control the amount recirculated.

In combination with acid cooling, the chloric acid generator can comprise a recirculation line 70 leading from the middle feed compartment 18 of the cell 20 to a coil 74 of heat exchanger 56, via recirculation pump 72. The coil 74 functions to cool at least a portion of the sodium chlorate in the middle feed compartment 18. The cooled sodium chlorate from coil 74 is returned to the middle feed compartment 18 by means of return line 77 which feeds into feed line 16 of the generator. In the embodiment illustrated in the Figure, the combined flows of line 77 and line 16 lead to the middle compartment 18 of cell 20 by means of line 76.

It is possible that some decomposition of chloric acid can occur at elevated temperatures. If desired, additional provision can be made for cooling the chloric acid in acid storage tank 44. This can be accomplished by means of recirculation line 64 which takes part of the flow from the acid cooling coil 54 and returns it directly to the acid storage tank 44. In this way, the temperature of the chloric acid is maintained in a cooled state in both the cell 20 and in the acid storage tank 44.

The cooling medium in the heat exchanger 56 can be any conventional cooling medium. A chilled bath type heat exchanger can be employed. Preferably, the recirculation rates and rates of cooling the chloric acid and recirculated chlorate solution are effective to maintain both the chlorate solution and anolyte (chloric acid) at a temperature in the range of about 10° to about 40° C., more preferably about 20° C. (room temperature).

The cathode 28 can be any suitable material conventionally employed as a cathode. Preferred such materials are a nickel, steel or titanium expanded metal mesh or sheet. Alternatively, the cathode can be a gas diffusion electrode such as disclosed in prior U.S. Pat. No. 4,377,496 entitled "Gas Diffusion Electrode and Process". A gas diffusion electrode, as disclosed in these patents, changes the cathode reaction to eliminate production of hydrogen while continuing to produce hydroxyl groups. Therefore, hydrogen is no longer evolved. The cell voltage is also substantially reduced resulting in a lower cost of electrical energy, as is reported in U.S. Pat. No. 4,377,496. The disclosure of this prior patent is incorporated herein by reference.

The anode can be either chlorine evolving or oxygen evolving depending on the electrolyte composition. A preferred anode is dimensionally stable. That is, the thickness of the anode does not decrease significantly during use. Such anodes usually comprise a film-forming valve metal substrate, such as titanium, tantalum, zirconium, niobium tungsten, and alloys thereof, which has the capacity to conduct an electrolyte current in the cathodic direction and to resist the passage of current in the anodic direction. These metals are also resistant to corrosion in the electrolytes at conditions used within an electrolytic cell. A preferred valve metal, based on cost, availability, and electrical and chemical properties, is titanium. It is well known that in the anodic direction, the valve metals passivate, that is the resistance of the valve metals to the passage of current goes up rapidly due to the formation of an oxide layer thereon. It is therefore customary to apply electrochemically active coatings to the valve metal substrate. The electrochemically active coatings have the capacity to continue to conduct current to the electrolyte, for example by the evolution of oxygen, over long periods of time without becoming passivated. Such coatings are those provided from platinum or other platinum group metals or they can be represented by active oxide coatings such as platinum group metal oxides, magnetite, ferrite, spinels, e.g. cobalt oxide, or mixed metal oxide coatings. The coatings also preferably contain at least one oxide of a valve metal with at least one oxide of a platinum group metal including platinum, palladium, rhodium, iridium, and ruthenium or mixtures thereof and with other metals.

An example of one such dimensionally stable oxygen evolving anode is a titanium substrate which has been coated with a precious metal oxide and valve metal oxide coating. This anode is marketed by the assignee of the present application under the trade designation EC-600. The anode 24 may be in the form of a sheet or expanded metal mesh. Examples of suitable chlorine evolving anodes that can be used in the present invention are disclosed in U.S. Pat. Nos. 3,632,498; 3,751,296; 3,778,307; 3,840,443 and 3,933,616.

For the production of perchloric acid, a lead oxide or platinum anode should be used.

The concentration of the sodium chlorate solution in feed line 16 can be a function primarily of the concentration of the acid desired in lines 42, 46. Chloric acid, at room temperature can decompose spontaneously at a concentration above about 3.6N. To produce chloric acid at a concentration less than 3.6N, it is necessary to feed to the middle compartment 18 a sodium chlorate solution having a normality less than about 4. The concentration of the chloric acid in lines 42, 46 is preferably above about 0.1. This requires a sodium chlorate feed having a normality more than about 0.1. Thus, the concentration of the sodium chlorate feed preferably is in the range of about 0.1N to about 4N.

However, an alternate method of operation is to feed a more concentrated chlorate solution to middle compartment 18, but to dilute the acid in lines 42, 46 with water so that the acid does not decompose. The alternate method has the advantage that it reduces the cell voltage required, since the conductivity of chlorate solution is higher at higher concentrations.

In this alternate method of operation, the concentration of the sodium chlorate solution in feed line 16 should be less than that at which precipitation of sodium chlorate occurs. Sodium chlorate has a maximum solubility of 7.4M at 0° C. and 10.7M at 23° C. The middle compartment 18 loses water with the migration of sodium ions to the cathode 28, and due to inefficiencies. The concentration of the chlorate solution in feed line 16 should take into account this loss of water, and thus can be near but should be somewhat less than the solubility limits, e.g., 10.7M, assuming the temperature in the cell to be about room temperature.

For the production of chlorine dioxide in an electrolytic cell as disclosed in prior U.S. Pat. No. 4,798,715, the chloric acid concentration preferably is above about 1.5, more preferably above about 2. This requires that the sodium chlorate solution feed in line 16 preferably have a normality of at least about 2.

The feed rate of the sodium chlorate solution in line 16 is a function of the amount of chlorate ion in the product lines 42, 46, the concentration of the sodium chlorate solution, and the water balance in the generator. The feed rate and concentration of the sodium chlorate solution can both be adjusted depending upon chlorate ion and water balances. An aspect of the present invention is that the feed of the sodium chlorate solution in line 16, suppresses the back-migration of protons through the diaphragm 30 to the cathode 28. This is important where an acid product of high normality is desired. The higher the normality of the acid, the higher the proton content in the anode compartment 22, and the greater the likelihood of back-migration of protons to the cathode 28.

Preferably, the generator of the present invention is operated at a relatively high current density, to reduce capital costs. Satisfactory results can be obtained with current densities in the range of about 2–5 kiloamps per square meter.

The following Examples illustrate the present invention.

EXAMPLE 1

A chloric acid generator 20 as shown in the Figure was operated to convert sodium chlorate into sodium hydroxide and chloric acid. The generator 20 employed an expanded mesh titanium anode 24 having a precious metal oxide coating marketed by the assignee of the present application under the trade designation EC-600. The cathode 28 was titanium mesh. The diaphragm 30 was a sheet of porous polytetrafluoroethylene ("Kynar") marketed by Porex Technologies Corp. under the trademark Porex. The diaphragm typically has an average void volume of about 40% and a density of about 1.05 grams per cubic centimeter. Average pore size is about 25 microns. The diaphragm has a service temperature up to about 300° F. (149° C.). The membrane 32 was made of NAFION 324 (trademark, E. I. DuPont de Nemours & Co.). The generator was constructed of chlorinated polyvinylchloride. The membrane 32 and diaphragm 30 had an active area of 20 square centimeters. The middle compartment 18 gap was 0.25 inches (0.64 cm).

The generator was operated under the following conditions:

| | |
|---|---|
| Current Density | 4 kiloamps per square meter |
| Voltage | 8.5 volts |

The following Table 1 shows measured temperatures, concentrations, and flow rates at various points in the generator. The chloric acid and sodium hydroxide product concentrations were measured to determine current efficiency at the anode and at the cathode.

TABLE 1

| Stream | Chlorate Feed Line 16 | Chlorate Feed Line 77 | Acid Product Line 46 | Sodium Hydroxide Product Line 34 | Acid Line 42 | Acid Recir. Line 64 |
|---|---|---|---|---|---|---|
| Temp. °C. | 25° C. | 16° C. | 18.6° C. | 30° C. | 26.5° | 16° |
| Conc. N | | | | | | |
| $NaClO_3$ | 3 | 3 | 1.87 | 0 | 1.87 | 1.87 |
| $HClO_3$ | 0 | 0.5 | 2.06 | 0 | 2.06 | 2.06 |
| NaOH | 0 | 0 | 0 | 6.59 | 0 | 0 |
| Flow (ml/min.) | 0.81 | 200 | 0.57 | 0.22 | 200 | 600 |

TABLE 2

| Stream | Chlorate Feed Line 16 | Chlorate Feed Line 77 | Acid Product Line 46 | Sodium Hydroxide Product Line 34 | Acid Line 42 | Acid Recir. Line 64 |
|---|---|---|---|---|---|---|
| Temp. °C. | 25° C. | NA | 24.3° C. | 45° C. | 59° C. | 32.6° |
| Conc. N | | | | | | |
| $NaClO_3$ | 3 | NA | 1.8 | 0 | 1.8 | 1.8 |
| $HClO_3$ | 0 | NA | 1.88 | 0 | 1.88 | 1.88 |
| NaOH | 0 | NA | 0 | 7.16 | 0 | 0 |
| Flow (ml/min.) | 0.52 | 0 | 0.3 | 0.2 | 190 | 600 |

Table 1 shows that both cooled acid and cooled salt were recirculated from the heat exchanger 56, in lines 64 and 77, respectively, at 16° C. This maintained the anolyte in line 42 at about 26.5° C. (the cell 20 and diaphragm 30 being at about the same temperature), and the chloric acid product in line 46 at about 18.6° C. The concentration of the chloric acid product obtained in line 46 was 2.06N. Cathode and anode current efficiencies were determined by dividing the actual production rates by the theoretical rates and multiplying by 100. Theoretical rates were based on amperage.

The following cell efficiencies were obtained:

| | |
|---|---|
| Cathode (NaOH) CE % | 29.1 |
| Anode ($HClO_3$) CE % | 23.6 |

The generator was disassembled at the end of 200 hours on line and the Porex diaphragm was in excellent condition. The generator has been successfully operated for longer periods.

EXAMPLE 2

The generator described in Example 1 was used. It was operated at the same current density of 4 kiloamps per square meter as in Example 1. The voltage drop in the cell was 7.5 as compared to 8.5 in Example 1. The following Table 2 gives measured temperature, concentrations and flow rates at various points in the generator. The major difference of operation from Example 1 was the absence of cooled recirculated chlorate solution in line 77 from heat exchanger 56. Thus, the cell was operated at a higher temperature of about 59° C., as evidenced by the temperature in anolyte product line 42.

The generator functioned for only 36 hours before excessive corrosion of the diaphragm 30 occurred. Current efficiencies were determined, as follows:

| | |
|---|---|
| Cathode (NaOH) CE % | 28.6 |
| Anode ($HClO_3$) CE % | 11.3 |

The concentration of the chloric acid in line 46 was only 1.8N. Thus, although the cell efficiency increased slightly for sodium hydroxide production when compared with Example 1, the cell efficiency was significantly less for acid production. The comparative data of Example 1 illustrates the importance of maintaining the generator 20, in the production of oxyhalogen acids, at a relatively low temperature. Example 1 also demonstrates that by sufficiently cooling the cell 20, the life of the diaphragm 30 can be significantly extended.

EXAMPLE 3

The purpose of this Example is to provide comparative data showing the advantages of use of a diaphragm, as separator 30, in the practice of the present invention, as compared to a membrane.

Four runs were conducted using Porex and Amerace diaphragms, disclosed above. The following Table 3 gives data collected on the runs.

TABLE 3

| Feed Na+, C103− N | CURR. DENS. KA/sqM | Volt | H+ Conc N | C103− Conc N | Acid Na+ Conc N | OH− Conc N | H+ CE % | Separator | Acid N to Feed N Ratio |
|---|---|---|---|---|---|---|---|---|---|
| 1 | 4 | 11.4 | 1.9 | 1.92 | 0.02 | 0.75 | 26.8 | Porex | 1.9 |
| 1 | 4 | 11.8 | 1.72 | 1.77 | 0.05 | 0.77 | 26.3 | Porex | 1.72 |
| 1 | 4 | 8.8 | 1.8 | 1.84 | 0.04 | 2.36 | 12.8 | Amerace | 1.8 |
| 2 | 4 | 12.5 | 2.81 | 2.91 | 0.1 | 4.75 | 23.2 | Amerace | 1.41 |

Table 3 shows that the sodium content in the acid product was as low as 0.02N (sixth column), and in all instances, was substantially less than that in the feed (1-2N, first column). High acid concentrations, in the range of about 1.72 to 2.81N, were obtained (fourth column), all above 1.7N.

In the following Table 4, data pertaining to the use of a membrane, as separator 30, is set forth. This data was extracted from Lipsztajn et al. U.S. Pat. No. 4,915,927. The membrane was an anion-exchange membrane marketed by Tosoh Corporation under the designation SA48.

TABLE 4

| Feed Na+, C103− N | CURR. DENS. KA/sqM | Volt | H+ Conc N | C103− Conc N | Acid Na+ Conc N | OH− Conc N | H+ CE % | Acid N to Feed N Ratio |
|---|---|---|---|---|---|---|---|---|
| 4.9 | 1 | 4.92 | 2.45 | 1.55 | 0.0046 | 3.08 | 37 | .5 |
| 1.6 | 1 | 5.46 | 1.14 | 1.08 | 0.0033 | 1.93 | 47 | .71 |
| 1.57 | 1 | 16.6 | 1.48 | 1.4 | 0.0015 | 2.08 | 44 | .94 |
| 4.88 | 3 | 7.09 | 1.98 | 1.94 | 0.0030 | 3.28 | 49 | .41 |
| 4.93 | 4 | 7.93 | 4.44 | 3.61 | 0.0052 | 5.26 | 36 | .90 |

The Lipsztajn et al. patent discloses a process for electrolytically-electrodialytically producing chloric acid from sodium chlorate. An electrolytic cell is provided. Chlorate ions from the sodium chlorate solution transfer through an anion-exchange membrane to combine with electrolytically produced hydrogen ions in a compartment of the cell to produce chloric acid. The sodium ions are transferred through a cation-exchange membrane to combine with electrolytically-produced hydroxyl ions in another compartment of the cell to produce sodium hydroxide.

Table 4 shows that the sodium concentration in the chloric acid which was produced, using a membrane separator, varied from about 0.0015 to about 0.0052N (column 6). These concentrations are lower than the sodium concentrations of Table 3. The differences, however, when compared to the sodium concentration in the feeds, are not significant. The data of Table 3 shows that an acid product can be obtained, using a diaphragm, which is nearly as pure as an acid product obtained using a membrane. This was a surprising discovery. An anionic membrane would be expected to achieve better cell efficiencies and a higher purity of acid product. A porous diaphragm allows the back-migration of protons to the cathode. This reduces current efficiency. In addition, a porous diaphram allows the flow of unreacted salt feed from the middle feed compartment to the anode compartment through the diaphragm. This dilutes the product acid and lowers its purity.

To inhibit back-migration of protons to the cathode, and subsequent loss of efficiency, the sodium chlorate feed, in the present invention, is forced through the diaphragm. The fluid velocity of the feed solution into the anode compartment from the middle compartment is maintained high enough to inhibit proton mobility through the diaphragm. It would be expected that this would cause even further dilution and reduction of purity in the product acid. It was surprising that this turned out not to be the case, that the acid product which was obtained, was nearly as pure as that obtained using a membrane.

The data of Tables 3 and 4 show the use of a diaphragm also gives an acid concentration higher than the feed concentration. A membrane does not. With a feed normality of one, a diaphragm gave an acid normality of about 1.72–1.9. With a feed normality of 2, a diaphragm gave an acid normality of 2.81. The ratio of acid normality to feed normality in all instances was about 1.41–1.9:1 (tenth column). In contrast, referring to Table 4, the ratio of acid normality to feed normality with a membrane was substantially less, for instance, 0.51:1 using a feed having a normality of 4.9 (tenth column). In all instances, the ratio was less than 1:1.

It is believed that the above results are due to a higher than expected migration of sodium cations from the anolyte compartment to the center chamber than would be expected. Three factors affect the ion transport through a diaphragm:

1. diffusion-caused by concentration gradients.
2. migration-caused by the electric field;
3. convection-caused by the bulk transport.

The sodium concentration differential of the electrolytes in the three chambers would favor its diffusion from the center chamber to the anolyte, and from the catholyte to the center chamber. The diffusion of sodium cations into the anolyte would be expected to be higher for a porous diaphragm than for an anionic membrane. The anionic membrane is resistant to cation transport. This would result in a lower purity acid with use of a diaphragm than with the use of an anionic membrane.

Sodium migration is from the anolyte and the center chamber to the cathod chamber. The migration of sodium cations from the anolyte to the center chamber might be expected to be higher for a diaphragm than for an anionic membrane. A diaphragm would be expected to offer little resistance to cation ($Na^+$) transport while an anionic membrane would inhibit cation transport.

Sodium convection is in the direction of the above liquid flow, from the center chamber toward the anolyte, in the case of using a diaphragm. Convection would be higher dependent on which separator is used. With an anionic membrane, there is essentially no convection from the center compartment to the anolyte. With a diaphragm, all of the feed passes from the center chamber to the anolyte, and there is a high amount of convection.

The combination of diffusion and convection through an anionic membrane would not be expected to be high enough to cause any substantial concentration of sodium to enter the anolyte requiring its removal by migration.

However, it is this combination of convection and diffusion that would be expected to result in high sodium contamination of the acid when a diaphragm is used.

Surprisingly, the purity is only marginally lower when a diaphragm is used instead of a membrane. It appears that the sodium migration from the anolyte and center chamber to the catholyte is dominant over sodium convection and diffusion into the anolyte, resulting in low sodium in the acid, even when a diaphragm is used.

One principle use for chloric acid is as a precursor in the manufacture of chlorine dioxide ($ClO_2$). Chlorine dioxide is a strong oxidizing agent. Some of the market areas for chlorine dioxide are: water treatment, pulp and paper processing, flour processing, municipal waste treatment, petroleum well injection, crop and meat storage, and bleaching such materials as textiles, oils, shellacs, varnishes, waxes, and straw products.

For water treatment, the use of chlorine dioxide is particularly attractive as environmental regulations are being tightened concerning the production of chlorinated organics and trihalomethanes (THM's). Trihalomethanes are significantly reduced with the use of chlorine dioxide instead of chlorine as a reactant.

One chlorine dioxide generating process, known as the Mathieson process, reacts sulfur dioxide with sodium chlorate ($NaClO_3$) and sulfuric acid to produce chlorine dioxide. This reaction also produces an undesirable sodium bisulfate salt cake ($NaHSO_4$). When this process is used in the pulp and paper industry, excess salt cake causes an imbalance for mills trying to reduce sulfur emissions.

An advantage of the chloric acid process of the present invention is that it can be integrated into the production of chlorine dioxide, for the pulp and paper industry, without the production of unwanted sodium bisulfate salt cake. Some sodium chlorate from the middle feed compartment 18 of the chloric acid generator flows into the anode compartment 22 making a mixture, in product line 46, of chloric acid and sodium chlorate. The sodium chlorate reacts with sulfur dioxide and sulfuric acid, as in the Mathieson process, to form some salt cake. However, the sulfur dioxide can be reacted preferentially with the chloric acid and sulfuric acid will be produced with very little salt cake. The sodium bisulfate salt that is produced can be separated from the sulfuric acid and recycled to the feed compartment 18 of the chloric acid generator of the present invention. In the chloric acid generator, the sodium bisulfate is converted to additional sodium hydroxide and sulfuric acid.

Processes similar to the Mathieson process, which use sodium chlorate and sulfuric acid as feed components, are known as the Solvay, R-2 and SVP processes. In the Solvay process, sodium chlorate is reacted with sulfuric acid and a reducing agent such as methanol to produce chlorine dioxide. This process produces, as a by-product, sodium sulfate ($Na_2SO_4$) which is of little value. By the present invention, chloric acid can be reacted directly with a reducing agent, such as methanol, to produce chlorine dioxide without producing the salt by-product. In the R-2 and SVP processes, sodium chlorate, sodium chloride, and sulfuric acid are reacted to produce chlorine dioxide. The processes also produce chlorine gas ($Cl_2$) and sodium sulfate as by-products. The chlorine gas is a particularly undesirable by-product.

The production of chlorine dioxide ($ClO_2$) contaminated with chlorine gas ($Cl_2$) is also disclosed in two patents, U.S. Pat. No. 4,806,215 "Combined Process for Production of Chlorine Dioxide and Sodium Hydroxide", and U.S. Pat. No. 4,853,096 "Production of Chlorine Dioxide in an Electrolytic Cell". The first patent is a three compartment cell which produces NaOH, $Cl_2$ and $ClO_2$ from HCl and $NaClO_3$. The second patent, in FIG. 3, describes a process for reducing, but not eliminating, the chlorine that contaminates the chlorine dioxide.

In the present invention, the chloric acid in line 46 can be reduced directly to chlorine dioxide by feeding the chloric acid to an electrochemical cell as disclosed in U.S. Pat. No. 4,798,715, discussed above, assigned to the assignee of the present application. An advantage of this reduction is that the chlorine dioxide is produced completely free of chlorine by-product gas. The disclosure of U.S. Pat. No. 4,798,715 is incorporated by reference herein.

Other uses for chloric acid are as a catalyst in the polymerization of acrylonitrile, and in the production of perchloric acid. In Kirk Othmer, Vol. 5, page 656, it is disclosed that chloric acid can be electrolytically oxidized to perchloric acid in an electrochemical process.

Perchloric acid uses are in medicine, in analytical chemistry, as a catalyst in the manufacture of various esters, as an ingredient of an electrolytic bath in the deposition of lead, in electro-polishing, and in the manufacture of explosives. The conventional method for producing ammonium perchlorate, disclosed in Kirk Othmer, Vol. 5, pg. 660, is to react sodium perchlorate, ammonia, and hydrochloric acid to produce ammonium perchlorate and by-product sodium chloride:

$$NaIO_4 + NH_3 + HCl \rightarrow NH_4ClO_4 + NaCl \quad (8)$$

In accordance with the present invention, sodium chlorate can be converted to chloric acid and sodium hydroxide with the three compartment cell as described above in reactions 1 through 7. The chloric acid is then electrolytically oxidized to perchloric acid using the electrochemical process described above and on pg. 656, Vol. 5 of Kirk Othmer. The perchloric acid can then be reacted with ammonia to produce ammonium perchlorate:

$$NH_3 + HClO_4 \rightarrow NH_4ClO_4 \quad (9)$$

As an alternative, sodium perchlorate can be converted to perchloric acid and sodium hydroxide in the three compartment acid generator. The perchloric acid can then be reacted with ammonia to produce ammonium perchlorate as in reaction (9).

From the above description of a preferred embodiment of the invention, those skilled in the art will perceive improvements, changes and modifications. Such improvements, changes and modifications within the skill of the art are intended to be covered by the appended claims.

What is claimed is:

1. A process for the production of chlorine dioxide comprising the steps of:

(a) establishing a solution of sodium chlorate having a molar concentration less than that at which precipitation of the sodium chlorate occurs, the sodium chlorate disassociating into sodium ions and chlorate ions in said solution;

(b) providing an electrolytic cell comprising an anode compartment containing an anode, a cathode compartment containing a cathode, and a middle feed compartment separated from the anode compartment by a diaphragm separator and from the cathode compartment by a cation-selective membrane;

(c) introducing said sodium chlorate solution into said middle feed compartment;

(d) applying a voltage across said cell to cause migration of sodium ions to the cathode and reaction of the sodium ions with hydroxyl ions to form sodium hydroxide, and migration of chlorate ions to the anode and reaction of the chlorate ions with protons to form chloric acid, said chloric acid having a normality in the range of about 1.5 to about 3.6:

(e) maintaining said cell at a temperature in the range of about 10° C. to 40° C.;

(f) providing a second eletrolytic cell; and (g) feeding said chloric acid to said second electrolytic cell and electrolyzing said chloric acid into hydrogen and chlorine dioxide in said second electrolytic cell.

2. The process of claim 1 wherein said chlorine dioxide is chlorine-free.

* * * * *